US011534888B2

(12) United States Patent
Yun et al.

(10) Patent No.: US 11,534,888 B2
(45) Date of Patent: Dec. 27, 2022

(54) POLISHING PAD WITH IMPROVED FLUIDITY OF SLURRY AND PROCESS FOR PREPARING SAME

(71) Applicant: SKC solmics Co., Ltd., Gyeonggi-do (KR)

(72) Inventors: Sunghoon Yun, Gyeonggi-do (KR); Jang Won Seo, Busan (KR); Hye Young Heo, Gyeonggi-do (KR); Jong Wook Yun, Gyeonggi-do (KR); Jaein Ahn, Gyeonggi-do (KR); Su Young Moon, Gyeonggi-do (KR)

(73) Assignee: SKC solmics Co., Ltd., Gyeonggi-do (KR)

( * ) Notice: Subject to any disclaimer, the term of this patent is extended or adjusted under 35 U.S.C. 154(b) by 818 days.

(21) Appl. No.: 16/395,993

(22) Filed: Apr. 26, 2019

(65) Prior Publication Data

US 2019/0389033 A1 Dec. 26, 2019

(30) Foreign Application Priority Data

Jun. 21, 2018 (KR) ..... 10-2018-0071232

(51) Int. Cl.
*B24B 37/26* (2012.01)
*B24B 37/22* (2012.01)

(52) U.S. Cl.
CPC ..... *B24B 37/26* (2013.01); *B24B 37/22* (2013.01)

(58) Field of Classification Search
CPC ..... B24B 37/20; B24B 37/26; B24B 37/22; B24B 37/24; B24B 37/245
See application file for complete search history.

(56) References Cited

U.S. PATENT DOCUMENTS 5,645,469 A 7/1997 Burke et al.
5,882,251 A * 3/1999 Berman ..... B24B 37/26 451/527
2003/0114084 A1* 6/2003 Moon ..... B24B 37/26 451/36
2004/0048552 A1* 3/2004 Kisboll et al. ..... B24B 37/26 451/41

(Continued)

FOREIGN PATENT DOCUMENTS

JP 2004-358616 A 12/2004
JP 2011-177884 A 9/2011

(Continued)

OTHER PUBLICATIONS

Office Action issued by Taiwanese Patent Office dated May 15, 2020.

(Continued)

*Primary Examiner* — Joel D Crandall
(74) *Attorney, Agent, or Firm* — IP & T Group LLP

(57) ABSTRACT

Provided is a polishing pad that comprises a plurality of first grooves that have a shape of geometric figures that share a center; and a plurality of second grooves that radially extend from the center to the outer perimeter, wherein the depth of the second grooves is equal to, or deeper than, the depth of the first grooves. It is possible for the polishing pad to rapidly discharge any debris generated during the polishing process to reduce such defects as scratches on the surface of a wafer.

11 Claims, 5 Drawing Sheets

(56) References Cited

U.S. PATENT DOCUMENTS

| | | | | |
|---|---|---|---|---|
| 2009/0209185 | A1* | 8/2009 | Motonari | B24B 37/26 451/527 |
| 2017/0274496 | A1* | 9/2017 | Cook | B24D 11/00 |
| 2017/0334034 | A1* | 11/2017 | Kadowaki | H01L 21/304 |
| 2018/0366333 | A1* | 12/2018 | Nguyen | H01L 21/31053 |

FOREIGN PATENT DOCUMENTS

| | | | |
|---|---|---|---|
| JP | 2016-124043 | A | 7/2016 |
| KR | 10-2005-0095818 | | 10/2005 |
| KR | 10-2014-0034128 | | 3/2014 |
| KR | 10-2017-0113203 | | 10/2017 |
| TW | 200708376 | A | 3/2007 |
| TW | 200804572 | A | 1/2008 |

OTHER PUBLICATIONS

Office Action issued by Japanese Patent Office dated Mar. 16, 2021.
Office Action issued by the Korean Intellectual Property Office dated Jun. 27, 2019.
Office Action issued by Japanese Patent Office dated Sep. 23, 2020.

* cited by examiner

POLISHING PAD WITH IMPROVED FLUIDITY OF SLURRY AND PROCESS FOR PREPARING SAME

The present application claims priority of Korean patent application number 10-2018-0071232 filed on Jun. 21, 2018, which is incorporated herein by reference in its entirety.

TECHNICAL FIELD

Embodiments relate to a polishing pad for use in a chemical mechanical planarization (CMP) process of semiconductors and a process for preparing the same.

BACKGROUND ART

The chemical mechanical planarization (CMP) process in a process for preparing semiconductors refers to a step in which a wafer is fixed to a head and in contact with the surface of a polishing pad mounted on a platen, and the wafer is then chemically treated by supplying a slurry while the platen and the head are relatively moved to thereby mechanically planarize the irregularities on the wafer surface.

A polishing pad is an essential member that plays an important role in such a CMP process. In general, a polishing pad is composed of a polyurethane-based resin and has grooves on its surface for a large flow of a slurry and pores for supporting a fine flow thereof.

The grooves may be of various shapes. For example, the groove may have a shape of circles that share a center (see Korean Laid-open Patent Publication No. 2005-95818). The grooves provided on a polishing pad serve to assist the planarization of the surface of a wafer by supporting a slurry while allowing the shiny to flow.

DISCLOSURE OF THE INVENTION

Technical Problem

In the CMP process, it is important not only to enhance the flatness of the surface of a wafer but also to reduce any defects that may occur in the polishing process. In particular, the debris generated during the CMP process may interpose between the wafer and the polishing pad, thereby causing irregular scratches, or penetrate into the equipment, thereby acting as a foreign matter.

Accordingly, the embodiments aim to provide a polishing pad that has a groove capable of expediting the polishing action of a slurry and rapidly discharging any debris generated during the CMP process to reduce such defects as scratches on the surface of a wafer, and a process for preparing the same.

Solution to the Problem

According to an embodiment, there is provided a polishing pad, which comprises a polishing layer, wherein the polishing layer comprises, on the polishing surface thereof, a plurality of first grooves that have a shape of geometric figures that share a center; and a plurality of second grooves that radially extend from the center to the outer periphery, and the depth of the second grooves is equal to, or deeper than, the depth of the first grooves.

According to another embodiment, there is provided a process for preparing a polishing pad, which comprises (1) preparing a polishing layer; (2) forming a plurality of first grooves on the polishing surface of the polishing layer, the first grooves having a shape of geometric figures that share a center; and (3) forming a plurality of second grooves on the polishing surface of the polishing layer, the second grooves radially extending from the center to the outer periphery, wherein the depth of the second grooves is equal to, or deeper than, the depth of the first grooves.

Advantageous Effects of the Invention

The polishing pad provided according to the embodiments has first grooves and second grooves on the polishing surface. The specific shape and dimension thereof are capable of expediting the polishing action of a slurry and rapidly discharging any debris generated during the polishing process to reduce such defects as scratches on the surface of a wafer.

Figure 1:
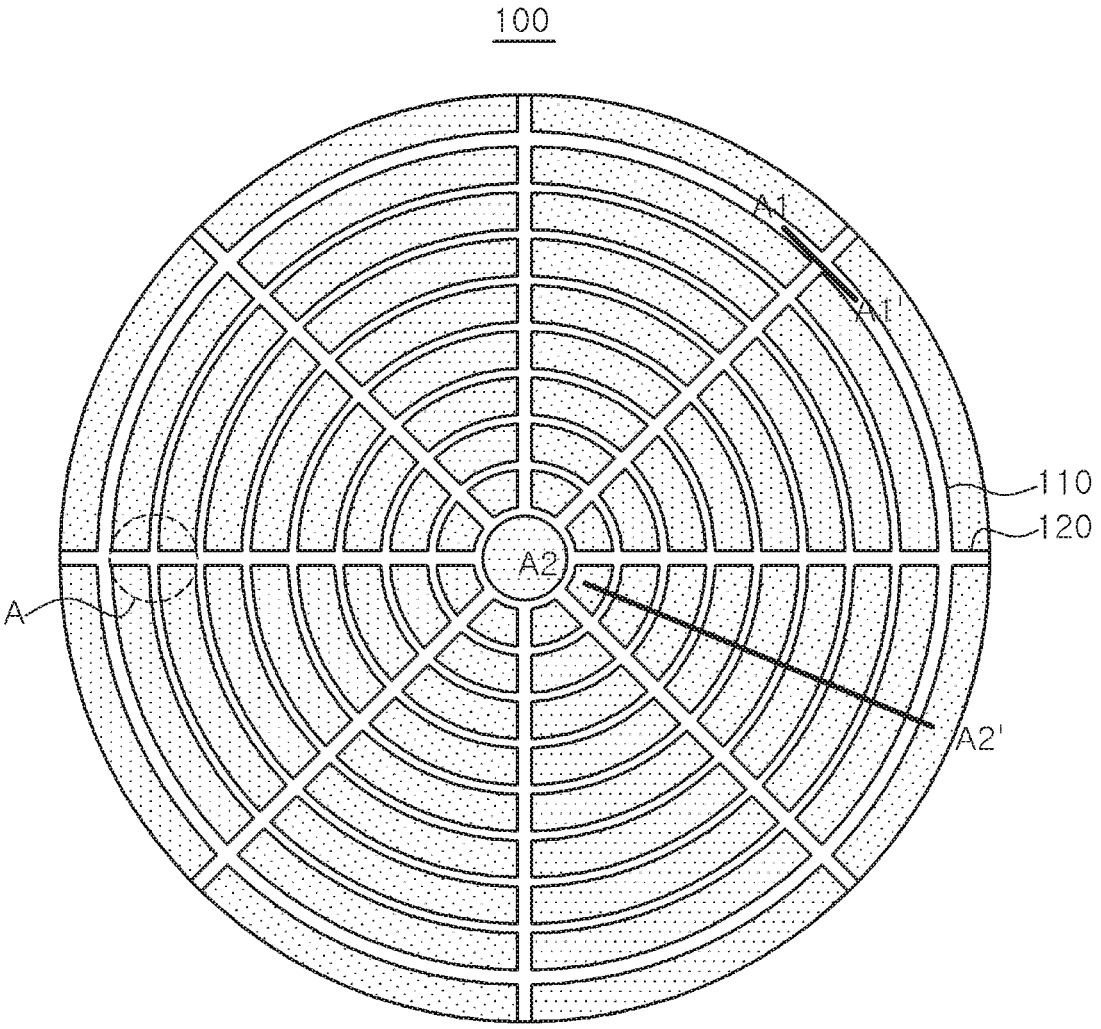
FIG. 1 is the plan view of a polishing pad according to an embodiment.

| Reference Numerals of the Drawings | |
|---|---|
| 100: polishing layer | 101: polishing surface |
| 110: first groove | 111, 121: inner surface |
| 112, 122: bottom surface | 120: second groove |
| 130: round portion | 131: first round portion |
| 132: second round portion | 133: third round portion |
| 200: support layer | 300: adhesive layer |
| 400: tip | 500: grinder |
| 510: grinding surface | A: enlarged region |
| h1: depth of a first groove | h2: depth of a second groove |
| w1: width of a first groove | w2: width of a second groove |
| t: thickness of a polishing layer | p: pitch of first grooves |
| A1-A1', A2-A2', B-B', C-C', D-D': cutting lines. | |

DETAILED DESCRIPTION OF THE INVENTION

Throughout the description of the embodiments, in the case where each layer, hole, window, or region is mentioned to be formed "on" or "under" another layer, hole, window, or region, it means not only that one element is "directly" formed on or under another element, but also that one element is "indirectly" formed on or under another element with other element(s) interposed between them.

In addition, the term on or under with respect to each element may be referenced to the drawings. For the sake of description, the sizes of individual elements in the appended drawings may be exaggeratingly depicted and do not indicate the actual sizes.

In addition, all numerical ranges related to the physical properties, dimensions, and the like of a component used herein are to be understood as being modified by the term "about," unless otherwise indicated.

Polishing Pad

The polishing pad according to an embodiment comprises a polishing layer, wherein the polishing layer comprises, on the polishing surface thereof, a plurality of first grooves that have a shape of geometric figures that share a center; and a plurality of second grooves that radially extend from the center to the outer periphery, and the depth of the second grooves is equal to, or deeper than, the depth of the first grooves, Polishing Layer The polishing layer comprises a polishing surface.

The polishing layer comprises a urethane-based polymer and may be porous.

The urethane-based polymer may be formed by a reaction between a urethane-based prepolymer and a curing agent. Specifically, the polishing layer may be formed from a polishing layer composition that comprises a urethane-based prepolymer, a curing agent, a foaming agent, and other additives.

The polishing layer may contain pores. The pores may have a structure of a closed cell or an open cell. The average diameter of the pores may be 5 μm to 200 μm. In addition, the polishing layer may contain 20% by volume to 70% by volume of pores with respect to the total volume of the polishing layer. That is, the porosity of the polishing layer may be 20% by volume to 70% by volume.

The thickness of the polishing layer is not particularly limited. Specifically, the average thickness of the polishing layer may be 0.8 mm to 5.0 mm, 1.0 mm to 4.0 mm, 1.0 mm to 3.0 mm, 1.5 mm to 2.5 mm, 1.7 mm to 2.3 mm, or 2.0 mm to 2.1 mm.

Groove

FIG. 1 is the plan view of a polishing pad according to an embodiment.

Referring to FIG. 1, the polishing layer (100) of the polishing pad comprises, on the polishing surface thereof, a plurality of first grooves (110) that have a shape of geometric figures that share a center; and a plurality of second grooves (120) that radially extend from the center to the outer periphery.

The first grooves serve to enhance the polishing efficiency by lowering the fluidity of a slurry. The second grooves serve to increase the fluidity of a slurry, thereby discharging debris generated during the polishing process.

As described above, the first grooves and the second grooves serve to control the fluidity of a slurry during the CMP process. The combination thereof can appropriately control the degree of maintenance and renewal of a slurry, thereby enhancing the polishing efficiency.

The planar shape of the first grooves is not particularly limited as long as it is geometric figures that share a center. For example, it may be a plurality of symmetrical figures that have different sizes while sharing a center, Specifically, it may be a plurality of concentric circles, concentric waves, or polygons (hexagons, octagons, star shapes, or the like) that share a center.

In addition, the planar shape of the second grooves may be, for example, a plurality of straight lines radially formed at a constant angular spacing and extending from the center to the outer periphery.

Referring to FIGS. 2*a*, 2*b*, 6*a*, and 6*h*, the first grooves (110) and the second grooves (120) may comprise inner surfaces (111 and 121) perpendicular to the polishing surface and bottom surfaces (112 and 122) parallel to the polishing surface.

Depth and Width of the Groove

Figure 2A:
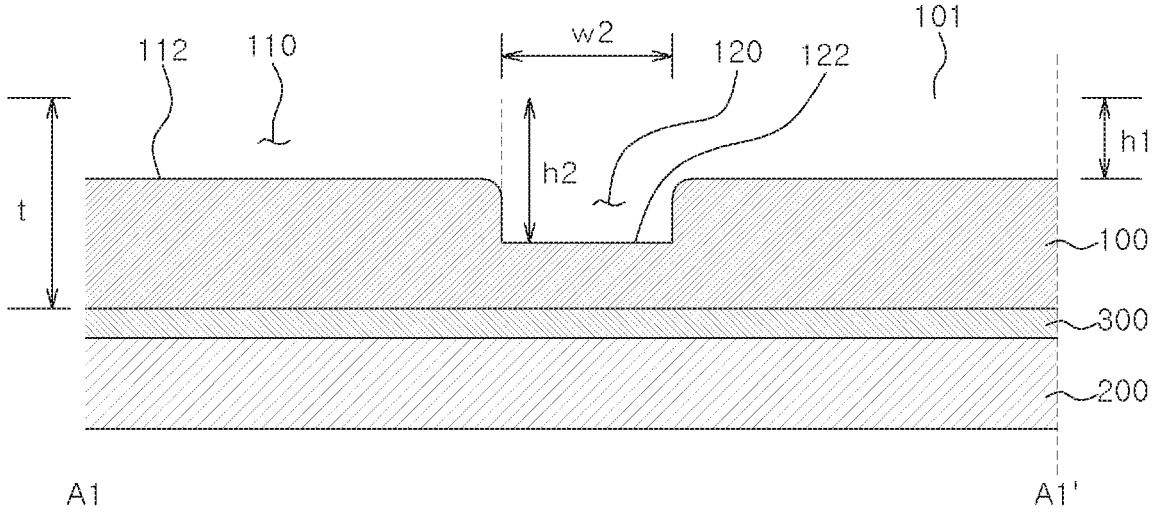
FIG. 2*a* is a cross-sectional view taken along the line A1-A1' in FIG. 1.
Figure 2B:
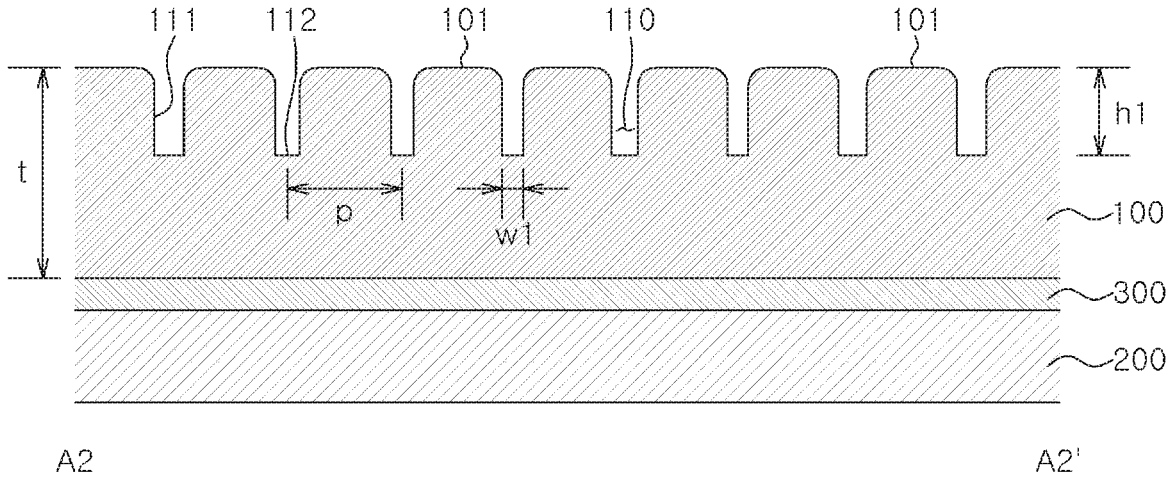
FIG. 2*b* is a cross-sectional view taken along the line A2-A2' in FIG. 1.

Referring to FIGS. 2*a* and 2*b*, the width (w1) of the first groove (110) is a value obtained by measuring the width of the bottom surface (112) of the first groove. The depth (h1) of the first groove (110) is a value obtained by measuring the vertical straight distance between the bottom surface (112) and the polishing surface (101).

In addition, the width (w2) of the second groove (120) is a value obtained by measuring the width of the bottom surface (122) of the second groove. The depth (h2) of the second groove (120) is a value obtained by measuring the vertical straight distance between the bottom surface (122) and the polishing surface (101).

The depths of the first groove and the second groove may be 0.4 mm to 4 mm, 0.4 mm to 2 mm, 1 mm to 2 mm, or 0.4 mm to 1 mm In addition, the widths of the first groove and the second groove may e 0.2 mm to 2 mm, 1 mm to 2 mm, 0.2 mm to 1 mm, or 0.2 mm to 0.6 mm.

According to an embodiment, the depth of the second grooves is equal to, or deeper than, the depth of the first grooves. For example, the depth of the second grooves may be 100% to 300% of the depth of the first grooves.

Alternatively, the depth of the second grooves may be greater than 100% to 300% or greater than 100% to 250% of the depth of the first grooves.

Alternatively, the depth of the second grooves may be 110% to 300%, for example, 120% to 300%, 120% to 200%, or 125% to 150% of the depth of the first grooves.

Within the above ranges, it is possible to enhance the fluidity of a slurry, whereby the discharge of debris generated in the polishing process can be more efficiently performed. At the same time, when a wafer is polished with the polishing pad, defects on the polished surface can be minimized while securing a proper polishing rate.

In addition, the depth (h2) of the second groove may be 90% or less of the thickness (0 of the polishing layer. Specifically-, the depth of the second groove may be 70% or less, or 50% or less, of the thickness of the polishing layer. More specifically, the depth of the second groove may be 10% to 70%, 10% to 60%, 30% to 70%, 20% to 50%, or 30% to 50% of the thickness of the polishing layer.

Within the above range, it is possible to prevent the deformation of the polishing layer due to the formation of the grooves while the fluidity of a slurry can be further enhanced.

In addition, the width of the second grooves may lie 50% to 300% of the width of the first grooves. Specifically, the width of the second grooves may be 50% to 200% or 100% to 200% of the width of the first grooves. Alternatively, the width of the second grooves may be 100% to 300%, 150% to 300%, or 200% to 300% of the width of the first grooves. Alternatively, the width of the second grooves may be 100% to 180%, 100% to 170%, 100% to 165%, or 100% to 160% of the width of the first grooves.

Within the above range, it is advantageous to enhance the fluidity of a shiny while securing a sufficient polishing area.

As a specific example, the width of the second grooves may be 50% to 200% of the width of the first grooves. In such event, the depth of the second groove may be 0.4 mm to 4 mm, and the width of the second groove may be 0.2 mm to 2 mm.

Spacing of Grooves

The polishing layer may comprise a plurality of the first grooves at a constant pitch spacing, Referring to FIG. 2*b*, the pitch spacing (p) of the first grooves (110) refers to the straight distance between the midpoints of the bottom surfaces (112) of any two of the first grooves.

Specifically, the polishing layer may have the first grooves at a pitch spacing of 1 mm to 10 mm. Alternatively, the polishing layer may have the first grooves at a pitch spacing of 1 mm to 5 mm. Alternatively, the polishing layer may have the first grooves at a pitch spacing of 2 mm to 4 mm.

In addition, the polishing layer may have the second grooves at a certain angle, for example, at a spacing of 10° to 50°, 15° to 45°, or 20° to 40°.

The polishing layer may have 5 to 15 of the second grooves spaced apart from each other at a certain angle. Specifically, the polishing layer may have 5 to 15 of the second grooves spaced apart from each other at a certain angle. Alternatively, the polishing layer may have 5 to 10, 10 to 15, or 7 to 12 of the second grooves spaced apart from each other at a certain angle.

Round Portion

The polishing layer may comprise a rounded portion machined as a curved surface at an edge at which the polishing surface meets the inner surface.

In each of the first grooves and the second grooves, an edge at which the inner surface of the groove meets the polishing surface comes into contact with the surface of a wafer during the CMP process.

In addition, the first groove and the second groove may intersect with each other. In such event, an apex formed by the intersection of the first groove and the second groove also comes into contact with the surface of a wafer during the CMP process.

In such event, it is apprehended that such defects as scratches may be formed on the surface of a wafer during the CMP process due to the edge at which the inner surface of the groove meets the polishing surface; and the apex formed by the intersection of the first groove and the second groove.

Accordingly, in order to prevent defects on the surface of a wafer during the CMP process, the polishing pad according to an embodiment comprises a round portion, which is machined as a curved surface, at an edge at which the inner surface of the groove meets the polishing surface and at an apex formed by the intersection of the first groove and the second groove.

Specifically, the round portion may comprise a first round portion formed at an edge at which the inner surface of the first groove meets the polishing surface; a second round portion formed at an edge at which the inner surface of the second groove meets the polishing surface; and a third round portion formed at an apex at which the inner surface of the first groove, the inner surface of the second groove, and the polishing surface meet.

Referring to FIGS. 5 and 6*a* to 6*c*, the round portion (130) may comprise a first round portion (131) formed at an edge at which the inner surface (111) of the first groove meets the polishing surface (101); a second round portion (132) formed at an edge at which the inner surface (121) of the second groove meets the polishing surface (101); and a third round portion (133) formed at an apex at which the inner surface (111) of the first groove, the inner surface (121) of the second groove, and the polishing surface (101) meet.

Specifically, the first round portion, the second round portion, and the third round portion may have a radius of curvature of 0.1 mm to 5 mm, 0.1 mm to 2 mm, or 0.3 mm to 1.5 mm. If the radius of curvature is within the above range, such defects as scratches on the surface of a wafer can be effectively prevented during the CMP process.

In addition, the first round portion, the second round portion, and the third round portion each may have a surface roughness (Ra) that is smaller than the surface roughness (Ra) of the bottom surfaces of the first groove and the second groove or the surface roughness (Ra) of the inner surface of the grooves.

The first round portion, the second round portion, and the third round portion each may have a surface roughness of 10 μm or less. Specifically, the first round portion, the second round portion, and the third round portion each may have a surface roughness of 0.01 μm to 5 μm or 0.01 μm to 3 μm. If the surface roughness is within the above range, the round portion can effectively prevent defects on the surface of a wafer during the process.

As a specific example, the first groove and the round portion may satisfy the following Relationships 1 and 2.

$$0.1<r/h1<1.5 \quad (1)$$

$$0.05<r/p<0.7 \quad (2)$$

In the above Relationships, r is the radius of curvature of the round portion, h1 is the depth of the first groove, and p is the pitch spacing of the first groove, Support Layer Referring to FIGS. 2*a* and 2*b*, the polishing pad may further comprise a support layer (200) disposed under the lower side of the polishing layer (100).

The support layer serves to support the polishing layer and to absorb and disperse an impact applied to the polishing layer. The hardness of the support layer may be smaller than the hardness of the polishing layer. The support layer may comprise a nonwoven fabric or a porous pad.

The support layer may contain pores. The pores contained in the support layer may have a structure of an opened cell or a closed cell. The pores contained in the support layer may have a shape that extends in the thickness direction of the support layer. In addition, the porosity of the support layer may be greater than the porosity of the polishing layer.

Adhesive Layer

Referring to FIGS. 2*a* and 2*b*, the polishing pad may further comprise an adhesive layer (300) interposed between the polishing layer (100) and the support layer (200). The adhesive layer serves to adhere the polishing layer and the support layer to each other. Further, the adhesive layer may suppress a polishing liquid from leaking from the upper part of the polishing layer downward the support layer.

The adhesive layer may comprise a hot-melt adhesive. Specifically, the adhesive layer may comprise a hot-melt adhesive having a melting point of 90° C. to 130° C. More specifically, the adhesive layer may comprise a hot-melt adhesive having a melting point of 110° C. to 1.30° C.

The hot-melt adhesive may be at least one selected from the group consisting of a polyurethane resin, a polyester resin, an ethylene-vinyl acetate resin, a polyamide resin, and a polyolefin resin. Specifically, the hot-melt adhesive may be at least one selected from the group consisting of a polyurethane resin and a polyester resin.

The thickness of the adhesive layer may be 5 μm to 30 μm, specifically 20 to 30 μm, more specifically 23 μm to 27 μm.

Window

The polishing pad may further comprise a window in the polishing layer. The window helps to determine the termination point of the CMP process by in-situ measuring the flatness and thickness of the surface of a wafer.

For example, the polishing layer has a first penetrating hole in the thickness direction, and a window may be inserted into the first penetrating hole. In addition, the support layer has a second penetrating hole in the thickness direction, and the first penetrating hole and the second penetrating hole may be connected to each other.

The window may be formed from a window composition that comprises a urethane-based prepolymer and a curing agent. Preferably, the window may be a non-foam. It is possible that no microbubbles are present in the window.

For example, the window may have a thickness of 2.3 mm to 2.5 mm, a light transmittance of 60% to 80%, and a refractive index of 1.45 to 1.60.

Process for Preparing a Polishing Pad

The process for preparing a polishing pad according to an embodiment comprises (1) preparing a polishing layer; (2) forming a plurality of first grooves on the polishing surface of the polishing layer, the first grooves having a shape of geometric figures that share a center; and (3) forming a plurality of second grooves on the polishing surface of the polishing layer, the second grooves radially extending from the center to the outer periphery, wherein the depth of the second grooves is equal to, or deeper than, the depth of the first grooves.

Preparation of a Polishing Layer

In the above step (1), a polishing layer is prepared.

The polishing layer may comprise a urethane-based polymer prepared from a composition that comprises a urethane-based prepolymer, a curing agent, a foaming agent, and other additives.

A prepolymer generally refers to a polymer having a relatively low molecular weight wherein the degree of polymerization is adjusted to an intermediate level so as to conveniently mold a molded article to be finally produced.

A prepolymer may be molded by itself or after a reaction with another polymerizable compound. Specifically, the urethane-based prepolymer may be prepared by reacting an isocyanate compound with a polyol and may comprise an unreacted isocyanate group (NCO). The isocyanate compound and the polyol compound are not particularly limited as long as they can be used for preparing a urethane-based polymer.

The curing agent may be at least one of an amine compound and an alcohol compound. Specifically, the curing agent may comprise at least one compound selected from the group consisting of an aromatic amine, an aliphatic amine, an aromatic alcohol, and an aliphatic alcohol.

The foaming agent is not particularly limited as long as it is commonly used for forming voids in a polishing pad. For example, the foaming agent may be at least one selected from a solid foaming agent having a void structure, a liquid foaming agent using a volatile liquid, and an inert gas.

Formation of a First Groove and a Second Groove

In the above step (2), a plurality of first grooves are formed on the polishing surface of the polishing layer, wherein the first grooves have a shape of geometric figures that share a center. In addition, in the above step (3), a plurality of second grooves are formed on the polishing surface of the polishing layer, wherein the second grooves radially extend from the center to the outer periphery.

In such event, the depth of the second grooves is equal to, or deeper than, the depth of the first grooves. To this end, it is necessary to form the second grooves later than the first grooves. If the second grooves are formed first, it may be inconvenient and difficult to form them deeper than the first grooves.

The specific configurations of the depths, widths, spacings, and the like of the first grooves and the second grooves are as exemplified above with respect to the polishing pad.

Figure 3A:
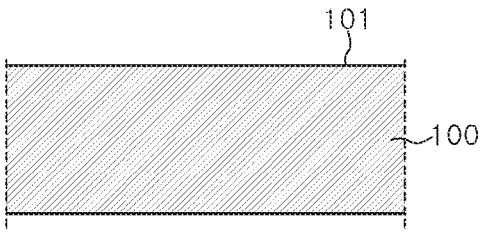
FIGS. 3*a* and 3*b* illustrate a method of forming a groove according to an embodiment.
Figure 3B:
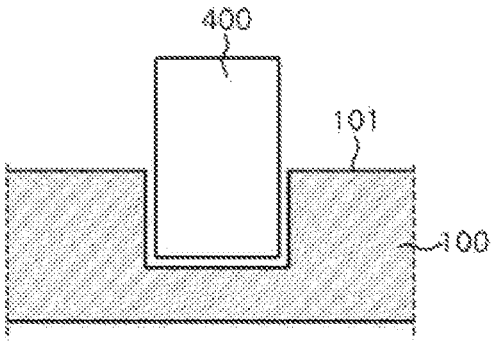

The formation of the first grooves and the second grooves may be carried out by cutting and removing a part of the polishing surface. For example, the cutting may be carried out using a tip. Referring to FIGS. 3*a* and 3*b*, the polishing surface (101) of the polishing layer (100) may be cut by the tip (400) to form a groove. Specifically, the tip is fixed so as to abut the polishing surface of the polishing layer, and then the polishing pad, which comprises the polishing layer, may be moved in a desired direction to remove a part of the surface of the polishing layer, thereby forming a groove. The formation of the first grooves and the second grooves may comprise forming an inner surface perpendicular to the polishing surface and a bottom surface parallel to the polishing surface by the cutting.

Curvature Machining

In addition, the process for preparing a polishing pad may further comprise, after the formation of the first grooves and the second grooves, machining an edge at which the polishing surface meets the inner surface into a curved surface.

The curvature machining may be carried out by removing a part of the edge at which the polishing surface meets the inner surface of the groove.

The curvature machining may be carried out by using a grinder or a chock.

Specifically, the curvature machining may be carried by removing a part of the edge at which the polishing surface meets the inner surface of the groove such that the radius of curvature becomes 0.1 mm to 5 mm, 0.1 mm to 2 mm, or 0.3 mm to 1.5 mm. If the radius of curvature is within the above range, such defects as scratches on the surface of a wafer can be effectively prevented during the CMP process.

Figure 4A:
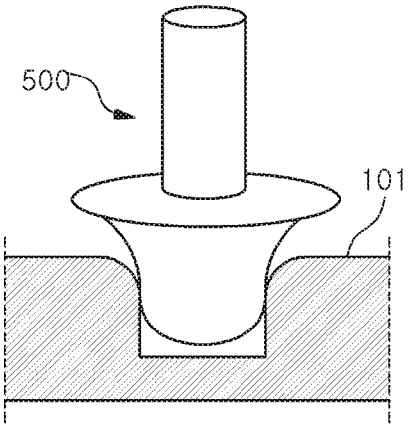
FIGS. 4*a* and 4*b* illustrate a method of forming a round portion and a grinder used therefor.
Figure 4B:
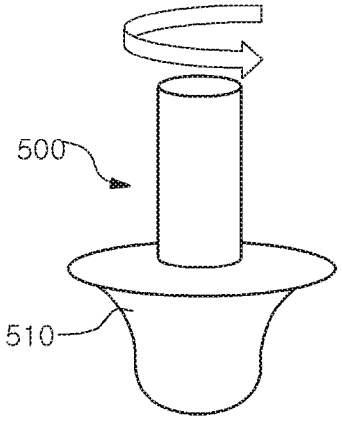
Figure 5:
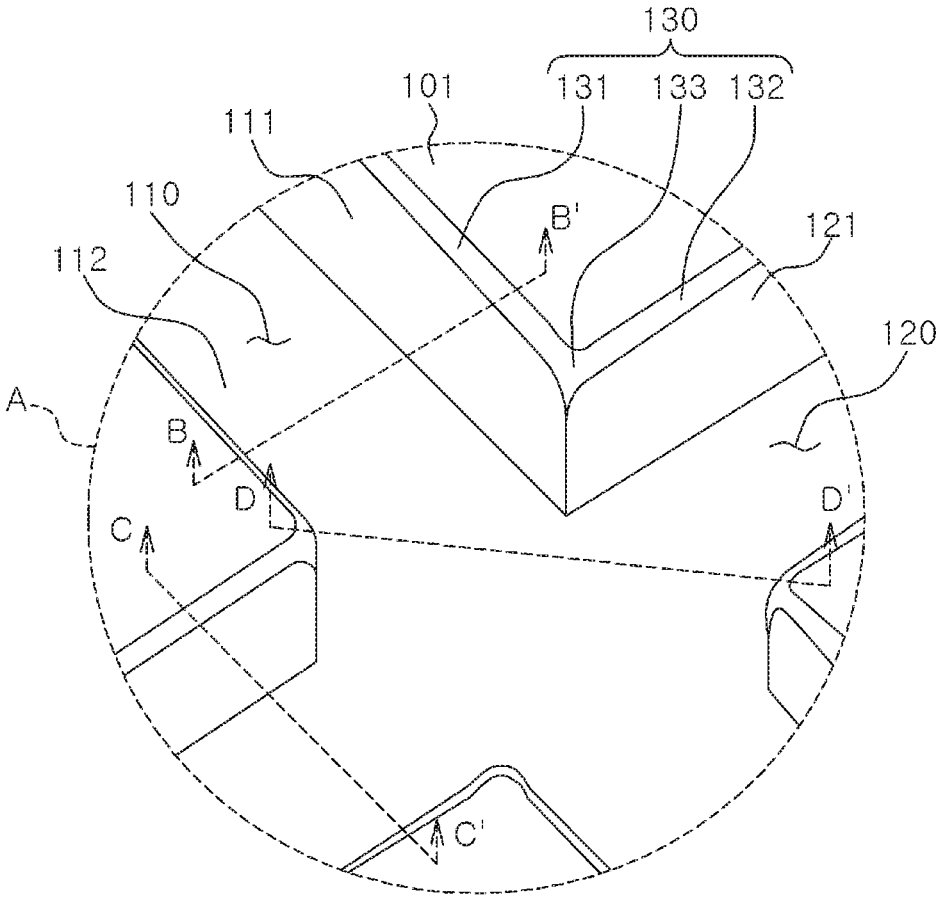
FIG. 5 is an enlarged perspective view of region A in FIG. 1 to illustrate a round portion.
Figure 6A:
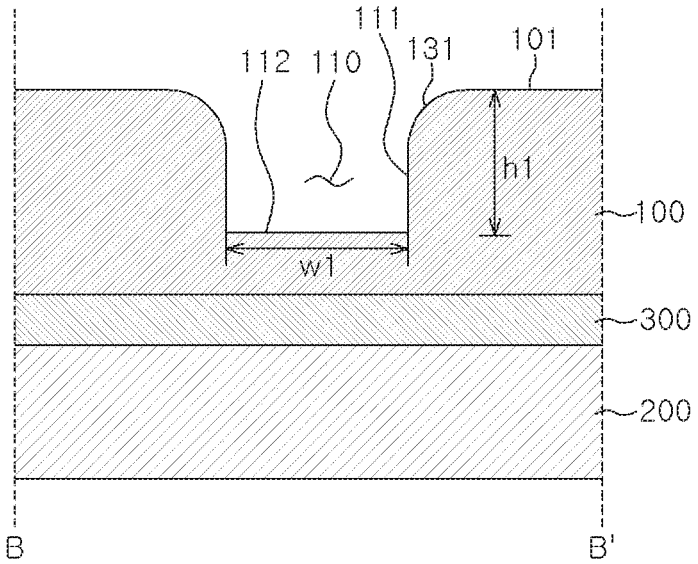
FIGS. 6*a* to 6*c* are cross-sectional views respectively taken along the lines C-C', and D-D' in FIG. 5.
Figure 6B:
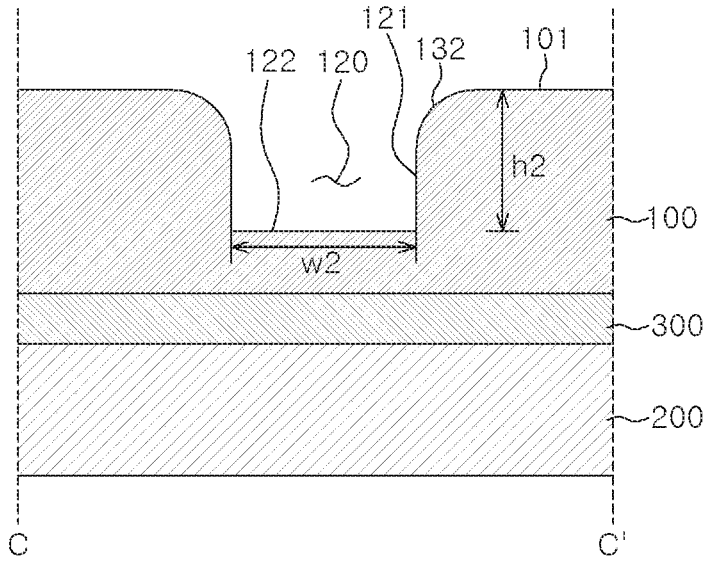
Figure 6C:
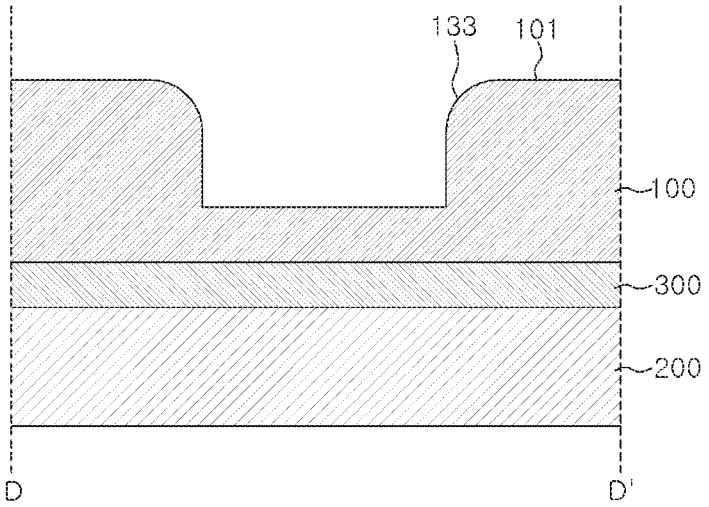

Referring to FIGS. 4*a* and 4*b*, the curvature machining may be carried out by using a grinder (500). In addition, the grinder (500) may comprise a grinding surface (510).

That is, the edge at which the polishing surface meets the inner surface of the groove may be machined into a curved surface by the grinding surface (510) of the grinder.

In addition, the grinder (500) can machine the edge at which the inner surface of the groove meets the polishing surface into a curved surface while it rotates in the direction of the arrow shown in FIG. 4*b*. In such event, the rotating speed of the grinder (500) may be 1,000 rpm to 50,000 rpm, 2,000 rpm to 35,000 rpm, or 5,000 rpm to 20,000 rpm.

The groove forming step and the curvature machining step as described above may be continuously carried out. As an example, the tip for forming the grooves and the grinder or the chock for the curvature machining are disposed adjacent to each other, so that the groove formation and the curvature machining can be continuously carried out on the polishing surface.

EXAMPLE

Hereinafter, the present invention is explained in detail by the following Examples. However, the scope of the present invention is not limited thereto.

Examples and Comparative Example: Preparation of a Polishing Pad

Step 1: Preparation of a Polishing Layer

A casting machine equipped with tanks and feeding lines for a prepolymer, a curing agent, an inert gas, and a reaction rate controlling agent was provided. A urethane-based prepolymer (NCO content: 8.0%, brand name: PUGL-450D, SKC) was charged to the prepolymer tank, bis(4-amino-3-chlorophenyl)methane (Ishihara) was charged to the curing agent tank, an argon (Ar) gas was charged to the inert gas tank, and a tertiary amine-based reaction rate promoting agent (brand name: A1, Air Product) was charged to the reaction rate controlling agent tank. The prepolymer, the curing agent, the inert gas, and the reaction rate controlling agent were stirred while they were fed to the mixing head at constant rates through the respective feeding lines. In such event, the prepolymer and the curing agent were fed while their equivalent ratio in the reactor was adjusted, wherein the total feeding amount was maintained at a rate of 10 kg/min. in addition, the reaction rate controlling agent was fed in a constant amount of 0.5% by weight based on the total feeding rate of the prepolymer and the curing agent. In addition, the inert gas was fed in a constant volume of 20% based on the total volume of the prepolymer and the curing agent. The mixed raw materials were injected into a mold (1,000 mm×1,000 mm×3 mm) and reacted to obtain a molded article in the form of a solid cake. Thereafter, the top and bottom of the molded article were each ground by a thickness of 0.5 mm to obtain a polishing layer having a thickness to 2 mm.

Step 2: Formation of Grooves

First grooves (concentric grooves) and second grooves (radial grooves) were formed on the polishing surface of the polishing layer using a tip as shown in Table 1 below. In such event, the first grooves were first formed, followed by the formation of the second grooves. Specifically, the tip was fixed so as to abut the polishing surface of the polishing layer, and then the polishing pad, which comprises the polishing layer, was rotated or moved to remove a part of the surface of the polishing layer, thereby forming the first grooves and the second grooves.

Meanwhile, for comparison, the second grooves were not formed in Comparative Example 1.

TABLE 1

| | First grooves (concentric grooves) (mm) | | | Second grooves (radial grooves) (mm) | | |
|---|---|---|---|---|---|---|
| | Width | Depth | Pitch | Width | Depth | Number |
| C. Ex. 1 | 0.5 | 0.8 | 3.0 | — | — | — |
| Ex. 1 | 0.5 | 0.8 | 3.0 | 0.5 | 0.8 | 8 |
| Ex. 2 | 0.5 | 0.8 | 3.0 | 0.5 | 1.0 | 8 |
| Ex. 3 | 0.5 | 0.8 | 3.0 | 0.5 | 1.2 | 8 |
| Ex. 4 | 0.5 | 0.8 | 3.0 | 0.8 | 1.2 | 8 |
| Ex. 5 | 0.5 | 0.8 | 3.0 | 1.5 | 1.2 | 8 |

Step 3: Attachment of a Support Layer

As a support layer, a porous pad (thickness: 1.1 mm, brand name: ND-5400H, PTS) was cut to a width of 1,000 mm and a length of 1,000 mm. The support layer and the polishing layer prepared above were laminated and melt-bonded at 120° C. and at a gap of 1.5 mm with a hot-melt film (average thickness: 40 μm, refractive index: 1.5, brand name: TF-00, SKC).

Test Example

The polishing pads obtained in the Examples and Comparative Example were tested for the following items. The results are shown in Table 2.

(1) Discharge Rate of Debris

While the chemical mechanical planarization (CMP) process was performed using the polishing pad for 1 hour, the wastewater discharged from the CMP equipment was filtered to collect solid debris. In such event, the collected debris was separated at intervals of 10 minutes, dried, and weighed. The discharge rate of debris was calculated according to the following equation.

Discharge rate of debris (mg/hr)=Weight of dried debris collected every 10 minutes×6

(2) Polishing Rate (Removal Rate, Å/Sec)

A silicon wafer having a diameter of 300 mm was deposited with silicon oxide by a CVD process. The polishing pad was mounted on a CMP machine, and the silicon wafer was set with the silicon oxide layer thereof facing the polishing surface of the polishing pad. The silicon oxide layer was polished under a polishing load of 4.0 psi while it was rotated at a speed of 150 rpm for 60 seconds and a calcined silica slurry was supplied onto the polishing pad at a rate of 250 ml/min. Upon completion of the polishing, the silicon wafer was detached from the carrier, mounted in a spin dryer, washed with distilled water (DIW), and then dried with nitrogen for 15 seconds. The changes in the film thickness of the dried silicon wafer before and after the polishing were measured using a spectral reflectometer type thickness measuring instrument (SI-F80R, Kyence)

The polishing rate was calculated using the following Equation.

Polishing rate (Å/sec)=difference in thickness before and after polishing (Å)/polishing time (second)

(3) Defects on a Wafer

After the silicon wafer was polished using the polishing pad, the surface of the silicon wafer before and after the polishing was observed using a wafer inspection equipment (AIT XP+, threshold: 150, die filter threshold: 280, KLA Tencor) to measure the number of scratches generated on the wafer by the polishing.

TABLE 2

| | Discharge rate of debris (mg/hr) | | | | Polishing rate | Defect |
|---|---|---|---|---|---|---|
| | 0-10 minutes | 10-20 minutes | 20-30 minutes | 50-60 minutes | (Å/sec) | (number) |
| C. Ex. 1 | 4.3 | 5.6 | 7.7 | 7.5 | 3,120 | 135 |
| Ex. 1 | 5.1 | 7.3 | 10.2 | 9.3 | 3,115 | 37 |
| Ex. 2 | 8.6 | 10.4 | 10.2 | 10.3 | 3,130 | 18 |
| Ex. 3 | 8.5 | 10.7 | 10.4 | 10.8 | 3,132 | 15 |
| Ex. 4 | 8.9 | 10.1 | 10.2 | 10.2 | 3,128 | 19 |
| Ex. 5 | 9.0 | 10.2 | 10.4 | 10.6 | 2,835 | 20 |

As shown in Table 2 above, the polishing pads of Examples 1 to 5 were evaluated to be excellent in the discharge rate of debris, polishing rate, and defects as a whole. In contrast, the polishing pad of Comparative Example 1 had a low discharge rate of debris and was poor in terms of defects. This is attributed to the fact that the polishing pads of Examples 1 to 5 had second grooves (radial grooves) whose depth was equal to, or deeper than, that of the first grooves (concentric grooves), which expedited the discharge of debris during the CMP process, thereby reducing the generation of scratches that might be generated between the wafer and the polishing pad.

In particular, the polishing pads of Examples 2 to 5 were more excellent in the discharge rate of debris, since the depth of the second grooves was deeper than that of the first grooves, which was more efficient in discharging debris during the CMP process. In addition, the polishing pads of Examples 2 to 4 among them were also excellent in the polishing rate, since the width of the first grooves and the width of the second grooves were controlled to secure a sufficient polishing area capable of achieving the polishing performance.

The invention claimed is:

1. A polishing pad, which comprises a polishing layer,
wherein the polishing layer comprises, on the polishing surface thereof,
a plurality of first grooves that have a same geometric shape and share a common center; and
a plurality of second grooves that radially extend from the center to the outer periphery,
wherein the depth of the second grooves is 125% to 150% of the depth of the first grooves,
wherein the width of the second grooves is 50% to 200% of the width of the first grooves,
wherein the first grooves and the second grooves each comprise an inner surface perpendicular to the polishing surface and a bottom surface parallel to the polishing surface,
wherein the polishing layer comprises a rounded portion which has a radius of curvature of 0.1 mm to 5 mm and which is machined as a curved surface at an edge at which the polishing surface meets the inner surface.

2. The polishing pad of claim 1, wherein the depth of the second grooves is 90% or less of the thickness of the polishing layer.

3. The polishing pad of claim 1, wherein the width of the second grooves is 100% to 200% of the width of the first grooves.

4. The polishing pad of claim 1, wherein the width of the second grooves is 0.2 mm to 2 mm, and the depth of the second grooves is 0.4 mm to 4 mm.

5. The polishing pad of claim 1, which has 5 to 15 of the second grooves spaced apart from each other at a certain angle.

6. The polishing pad of claim 5, which has the first grooves at a pitch spacing of 1 mm to 10 mm.

7. A process for preparing a polishing pad, which comprises:
(1) preparing a polishing layer;
(2) forming a plurality of first grooves on the polishing surface of the polishing layer, the first grooves having a same geometric shape and sharing a common center; and
(3) forming a plurality of second grooves on the polishing surface of the polishing layer, the second grooves radially extending from the center to the outer periphery,
wherein the depth of the second grooves is 125% to 150% of the depth of the first grooves,
wherein the width of the second grooves is 50% to 200% of the width of the first grooves,
wherein the first grooves and the second grooves each comprise an inner surface perpendicular to the polishing surface and a bottom surface parallel to the polishing surface,
wherein the polishing pad comprises a rounded portion machined as a curved surface at an edge at which the polishing surface meets the inner surface, and
wherein the rounded portion has a radius of curvature of 0.1 mm to 5 mm.

8. The process for preparing a polishing pad of claim 7, wherein the formation of the first grooves and the second grooves is carried out by cutting and removing a part of the polishing surface.

9. The process for preparing a polishing pad of claim 8, wherein the cutting is carried out using a tip.

10. The process for preparing a polishing pad of claim 8, wherein the formation of the first grooves and the second grooves comprises forming an inner surface perpendicular to the polishing surface and a bottom surface parallel to the polishing surface by the cutting.

11. The process for preparing a polishing pad of claim 10, which further comprises, after the formation of the first grooves and the second grooves, machining an edge at which the polishing surface meets the inner surface into a curved surface.

* * * * *